US005086520A

United States Patent [19]

Arai

[11] Patent Number: 5,086,520

[45] Date of Patent: Feb. 11, 1992

[54] VENTILATING DEVICE FOR HELMET

[76] Inventor: Michio Arai, 1-164, Horinouchi, Ohmiya-shi, Saitama-ken, Japan

[21] Appl. No.: 602,200

[22] Filed: Oct. 22, 1990

[30] Foreign Application Priority Data

Nov. 7, 1989 [JP] Japan ..... 1-130478[U]

[51] Int. Cl.[5] ..... A42B 1/08

[52] U.S. Cl. ..... 2/424; 2/425; 2/171.3

[58] Field of Search ..... 2/410, 411, 414, 422, 2/425, 171.3, 171.4

[56] References Cited

U.S. PATENT DOCUMENTS

| | | | |
|---|---|---|---|
| 4,075,714 | 2/1978 | Ryder et al. | 2/425 |
| 4,115,874 | 9/1978 | Hasegawa | 2/425 |
| 4,141,085 | 2/1979 | Adams, Sr. | 2/410 |
| 4,700,411 | 10/1987 | Kawasaki et al. | 2/425 |
| 4,704,746 | 11/1987 | Nava | 2/425 |

FOREIGN PATENT DOCUMENTS

| | | | |
|---|---|---|---|
| 252243 | 1/1988 | European Pat. Off. | 2/410 |
| 268549 | 5/1988 | European Pat. Off. | 2/410 |
| 3316920 | 11/1984 | Fed. Rep. of Germany | 2/410 |
| 3344706 | 6/1985 | Fed. Rep. of Germany | 2/410 |
| 3407403 | 8/1985 | Fed. Rep. of Germany | 2/425 |
| 61-73624 | 5/1986 | Japan . | |
| 2075820 | 11/1981 | United Kingdom | 2/425 |

*Primary Examiner*—Werner H. Schroeder
*Assistant Examiner*—Michael A. Neas
*Attorney, Agent, or Firm*—Klauber & Jackson

[57] ABSTRACT

A ventilating device for a helmet wherein a ventilation passage for communication between the interior and the exterior of a helmet body is formed near the head top of the helmet body; and an induction duct is mounted above the communication passage so as to be slidable longitudinally and rotatable; and the opening and closing of the ventilation passage are changed over from one to the other by longitudinal sliding and rotation of the induction duct, whereby the outside air can be introduced into the interior of the helmet body, the air staying in the interior can be discharged, and also these operations can be stopped.

4 Claims, 5 Drawing Sheets

VENTILATING DEVICE FOR HELMET

BACKGROUND OF THE INVENTION

1. Field of the Invention

The present invention relates to a helmet for protecting the head of a driver of a motorcycle, a four-wheeled vehicle, or the like.

2. Description of the Prior Art

Generally, as helmets for motorcycle and four-wheeled drivers there are known a full-face type helmet and a jet type helmet. Particularly, in the former, full-face type helmet, the helmet is fitted on the driver's head completely, so when a transparent shield for opening and closing a window opening formed on the front side is closed, the driver's head gets stuffy due to heat and the driver feels quite uncomfortable.

As a helmet of this type designed to prevent the driver's head from getting stuffy and hot by introducing air into the interior of the helmet, there has been proposed a full-face type helmet having an air inlet formed near the upper edge of the window opening to blow off air to the interior of the helmet. However, since the position of the said air inlet corresponds to the forehead portion, the helmet is apt to be broken by shock in the event the driver falls down. Besides, a certain opening area causes deterioration of strength. Thus, it is possible that this helmet will no longer fulfill the function as a protective helmet.

In view of the above situation the applicant in the present case has proposed as Japanese Utility Model Laid-Open No. 73624/86 a ventilating device capable of introducing the outside air into the interior of a helmet without deteriorating the protecting function and strength of the helmet. In the invention disclosed therein, a communication hole for introducing the outside air into the helmet body is formed so that it can be opened and closed to fulfill two functions, that is, introduction of the outside air and stop thereof.

For ventilating the interior of a helmet, not only the introduction of the outside air but also the discharge of the inside air is considered. In other words, the aforementioned invention has only one ventilating function and is difficult to be considered fully satisfactory.

SUMMARY OF THE INVENTION

The present invention has been accomplished in view of the above-mentioned points and it is the object thereof to provide a ventilating device capable of introducing the outside air into the interior of a helmet, discharging the inside air from the helmet and closing the air flow path through such simple operations as rotation and sliding without deteriorating the protecting function and strength of the helmet.

In the ventilating device for a helmet according to the present invention, in order to achieve the above-mentioned object, a ventilation passage which opens to the interior of a helmet body is formed, extending from the outer surface of a cap member of the helmet body in a position near the head top through the cap member and a shock absorbing member; a base plate having a communication hole for communication with the said ventilation passage is fixed to the outer surface of the cap member; an induction duct defining a flow path which is generally L-shaped in section and having a through-hole formed in the bottom thereof in conformity with the said communication hole is attached to the base plate; in this mounted state the communication hole can be opened and closed by sliding the induction duct in the longitudinal direction; and by rotating the induction duct the supply of air into the interior of the helmet body and the discharge of air therefrom can be changed over from one to the other.

The induction duct engaged with the base plate is formed using a synthetic resin material having elasticity (springness) and is mounted so that it can be disengaged from the base plate when a large external force which would endanger the duct is exerted thereon. Between the base plate and the induction duct there is provided a ratchet mechanism for making positional control at the time of rotation and longitudinal sliding of the duct.

According to the above construction, the communication hole is opened and closed by setting the induction duct in a forwardly facing position and sliding it longitudinally, and in an opened state thereof the outside air can be introduced into the interior of the helmet, while if in this state permitting the introduction of the outside air the induction duct is turned 180° and thereby set in a rearwardly facing position, it becomes possible to discharge the inside air to the exterior of the helmet by suction under the action of a negative pressure. Further, the communication hole can be opened and closed by sliding the duct longitudinally in the rearwardly facing state.

According to the ventilating device for a helmet of the present invention having the above construction, the introduction of the outside air into the interior of the helmet and the discharge of the inside air therefrom can be done by setting the induction duct in the forwardly or rearwardly facing state and opening the communication hole. Besides, the forwardly facing state and the rearwardly facing state can be changed over easily by rotating the induction duct.

Not only the forwardly facing state but also the rearwardly facing state of the induction duct the communication hole can be opened and closed by sliding the duct in the longitudinal direction, and hence it is possible to stop the introduction of the outside air and also stop the discharge of the inside air as necessary.

Further, since a ratchet mechanism is provided on the sliding surface of the base plate and the induction duct, the duct can be slid with nodes; that is, the degree of opening of the communication hole can be adjusted stepwise.

Thus, the ventilation in the interior of the helmet can be effected more effectively not only the introduction of the outside air but also by the discharge of the inside air from the helmet.

BRIEF DESCRIPTION OF THE DRAWINGS

The drawings illustrate embodiments of the present invention, in which.

DETAILED DESCRIPTION OF PREFERRED EMBODIMENTS

Figure 1:
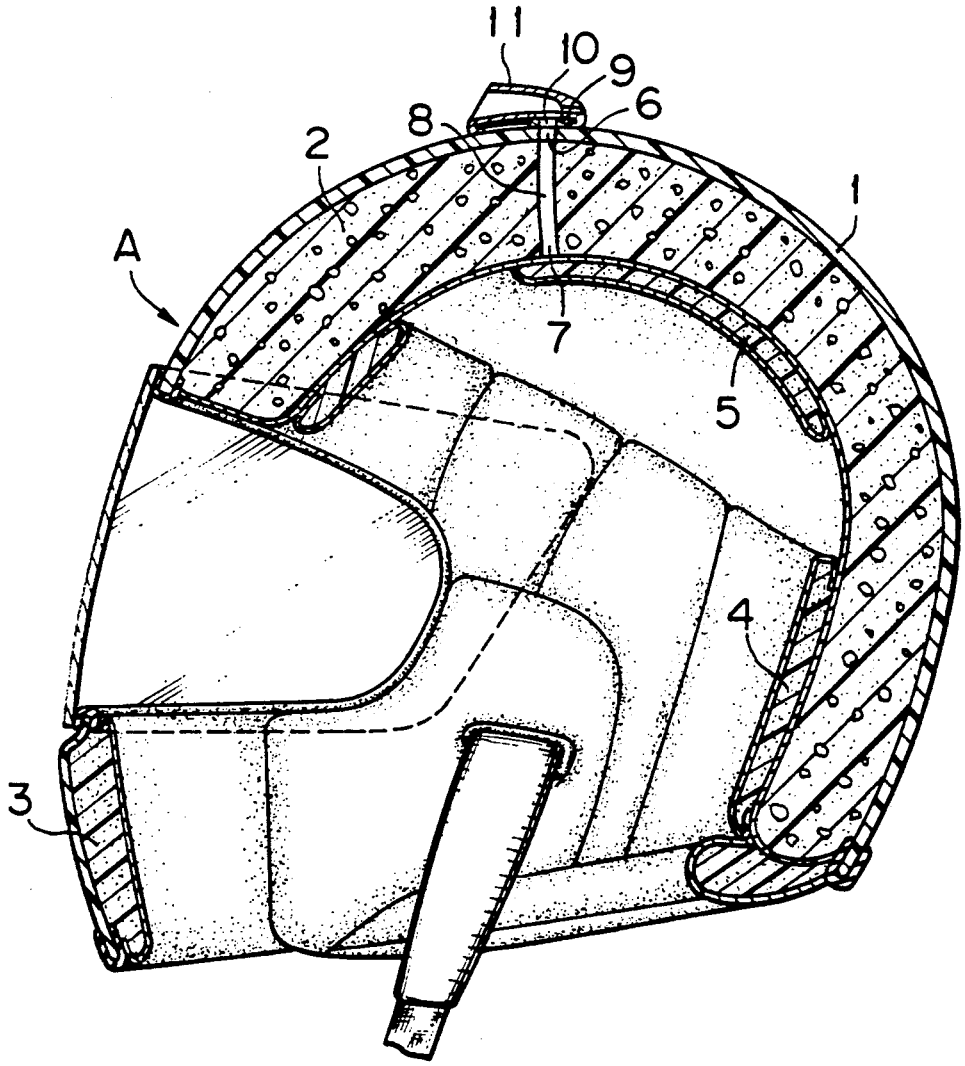
FIG. 1 is a front view in longitudinal section of a ventilating device embodying the invention.

Embodiments of the present invention will be described in detail hereinunder with respect to a full-face type helmet as an example.

A full-face type helmet A comprises a cap member 1 formed by molding using FRP (Fiber glass Reinforced Plastic) for example, a shock absorbing member 2 fitted on the inside of the cap member 1 and formed using polyethylene foam or a material which exhibits a shock absorbing performance equal or superior to that of polyethylene foam, a jaw guard 3 formed of polystyrene foam for example and extending from a jaw portion to temple portions on both right and left sides in the cap member 1, a wearing member comprising a side cushion 4 and a head cushion 5 which are fitted on the inner surface of the shock absorbing member 2 and formed using an air-permeable cushioning material, and a chin-strap.

An air inlet 6 is formed in the top portion of the cap member 1 and a ventilation passage 8 is formed through the cushioning member 2 so as to communicate with the air inlet 6, the ventilation passage 8 having a blow-off port 7 which is open to the front portion of the air-permeable head cushion 5 fitted on the inner surface of the cushioning member 2. The position of the blow-off port 7 of the ventilation passage 8 is not limited to the illustrated position. It may be any position if only the interior of the helmet can be ventilated efficiently.

A relatively thin (about 3 mm) base plate 9 which has a communication hole 10 communicating with the air inlet 6 and which is generally oval-shaped in plan view, is fixed to the outer surface of the cap member 1 of the helmet A, using an adhesive for example. On the underside of the outer peripheral edge of the base plate 9 there is formed a stepped portion 13 for engagement with an engaging pawl 12 formed on an induction duct 11. The underside of the base plate 9 which is in abutment with the outer surface of the cap member 1 is formed in a concavely spherical shape for close contact with a curved surface of the cap member 1. The base plate 9 has a planar shape obtained by cutting the circumferential edge of a disc with a straight line parallel to the diameter of the disc. The induction duct 11 is formed in a flat cylindrical shape having a generally V-shaped section, using a synthetic resin material having flexibility, and in an inner part of a bottom 11*a* which is in close contact with the upper surface of the base plate 9 there is formed a through-hole 14 in conformity with the communication hole 10 formed in the base plate 9. Further, the engaging pawl 12 for engagement with the stepped portion 13 of the base plate 9 is formed on the underside of the bottom 11*a* in a generally keyhole shape in plan view.

The engaging pawl 12 on the underside of the bottom of the induction duct 11 is formed in a generally keyhole shape in a plan view by a circular portion 15*a* which permits a horizontal rotation of the duct 11 about the base plate 9 and also by a rectilinear portion 15*b* which permits a rectilinear sliding of the duct 11 with respect to the base plate 9. The through-hole 14 is formed in the bottom 11*a* of the induction duct 11 in a central position of the circular portion 15*a* so that it is in conformity and communication with the communication hole 10 of the base plate 9. The engaging pawl 12 and the stepped portion 13 are engaged with each other to the extent that when an external force is applied to the induction duct 11, the duct is easily disengaged from the base plate 9.

Further, a small hole 16 which communicates with the interior of the induction duct 11 is formed through a rear wall portion of the duct on the side opposite to the front opening of the duct. The small hole 16 serves to promote the introduction of the outside air and also promote the suction of the inside air from the helmet at the time of discharge of the same air. In the engaged portion of the base plate 9 and the induction duct 11 there may be provided a ratchet mechanism so that the rotation and sliding of the duct 11 can be done with nodes.

The ratchet mechanism will now be described. As illustrated in FIGS. 10 to 16, an elastic engaging piece 19 which exhibits springness in the vertical direction is formed on the base plate 9 side, and an engaging lug 20 is formed on the upper surface of the elastic engaging piece 19. On the surface of the induction duct 11 which is slidable and rotatable relative to the base plate 9 and which is in contact with the base plate, a plurality of engaging concaves 21 for fitting therein of the engaging lug 20 are formed in the sliding direction of the duct 11. The engaging concaves 21 are positioned so that the degree of opening of the communication hole 10 formed in the base plate 9 can be adjusted in two or three stages from full open to full closed. As a result, the longitudinal sliding of the induction duct 11 is performed with nodes and the degree of opening of the communication hole 10 can be adjusted stepwise.

The side cushion 4 and the head cushion 5 attached to the inside of the shock absorbing member 2 are formed by covering a cushioning material superior in air permeability with a cloth which feels soft and is superior in air permeability. An example of such cushioning material is a coarse net-like polyurethane foam.

The operation of the ventilating device having the above construction will be described below.

Figure 6:
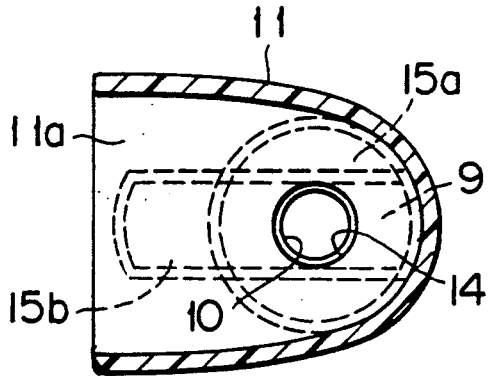
FIGS. 6 to 9 are plan views of FIGS. 2 to 5, respectively.

First, the induction duct 11 is mounted to the base plate 9 so that the front opening thereof faces an advancing direction, and the communication hole 10 of the base plate 9 and the through-hole 14 of the induction duct 11 are aligned and communicated with each other. As a result, the air which has entered the duct 11 flows from the communication hole 10 to the ventilation passage 8 through the air inlet 6 of the cap 1, then is blown off to the interior of the helmet body A, flows through the gap between the helmet body and the wearer's head and also flows through the side cushion 4 and head cushion 5 to cool the whole of the head. Thereafter, the air flows out from the lower side of the rear portion of the helmet body A. (See FIGS. 2 and 6.)

Figure 7:
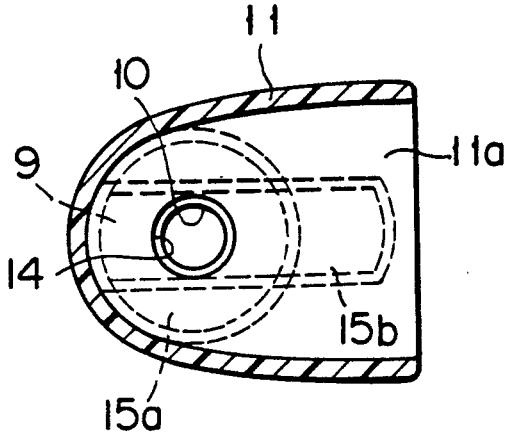

The reason why the air which has been blown off into the helmet body A flows out from the lower side of the rear portion is because the rear side of the wearer's neck projecting downwards from the helmet body becomes negative in pressure and hence the air present inside the helmet body is drawn out. In the above state, when the induction duct 11 is turned 180° by the engaging pawl 12 of the circular portion 15*a* to change the position of the front opening into the position opposite to the advancing direction, the opening portion of the duct 11 becomes negative in pressure, so that the air present inside the helmet body A is drawn out by suction. The outside air enters the induction duct 11 through the small hole 16 and flows out from the opening of the duct to form a flow of air, whereby the suction through the ventilation passage 8 is further promoted. (See FIGS. 3 and 7.)

Figure 2:
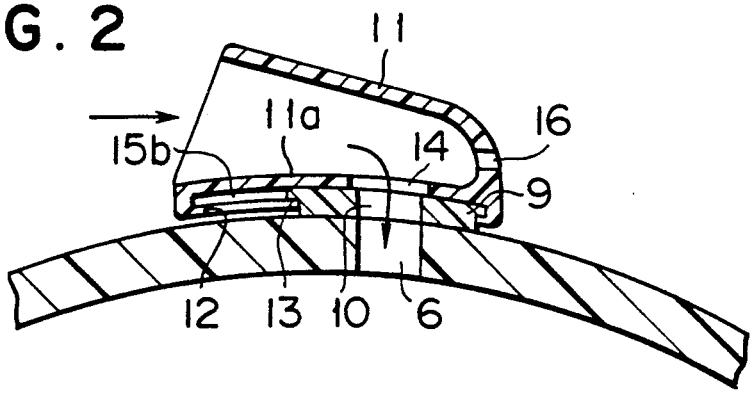
FIG. 2 is an enlarged sectional view showing an induction duct set in an outside air introducing state.
Figure 4:
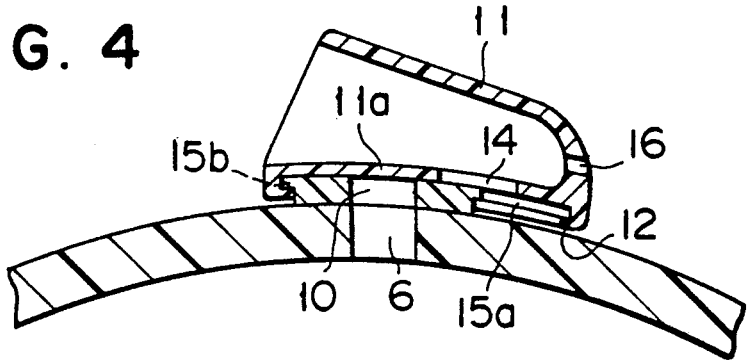
FIG. 4 is an enlarged sectional view showing the induction duct which has been slid backwards from the state of FIG. 2.
Figure 8:
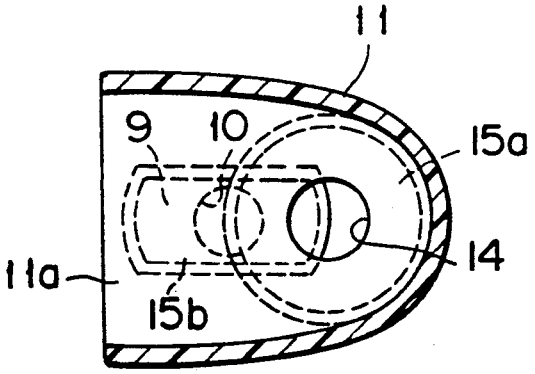

In the state shown in FIG. 2, if the induction duct 11 is slid backwards by the engaging pawl 12 of the rectilinear portion 15*b*, the communication hole 10 of the base plate 9 is closed with the bottom 11*a* of the duct 11, so that it is no longer possible to introduce the outside air into the helmet body A. In this case, the through-hole 14 of the duct 11 is located on the plate portion in a position other than the position of the communication hole 10 of the base plate 9. (See FIGS. 4 and 8.)

Figure 3:
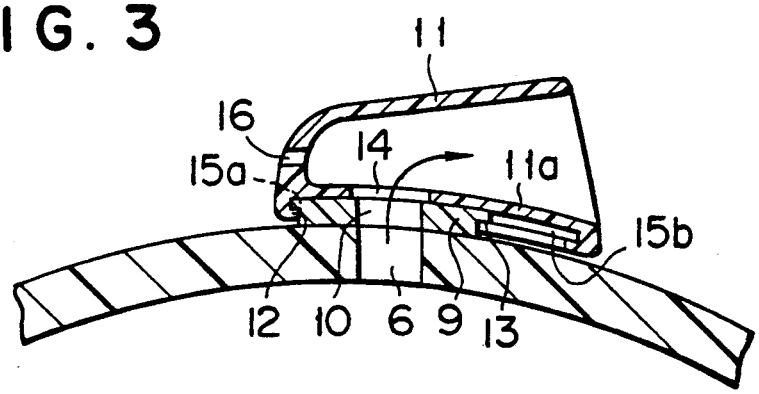
FIG. 3 is an enlarged sectional view showing the induction duct which has been turned 180° for discharging the inside air of a helmet.
Figure 5:
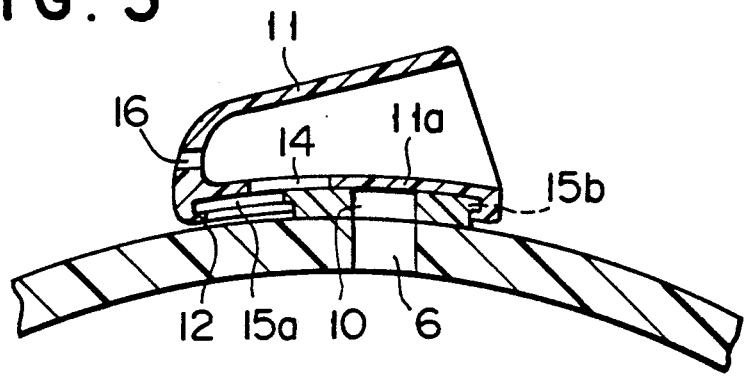
FIG. 5 is an enlarged sectional view showing the induction duct which has been slid forwards from the state of FIG. 3.
Figure 9:
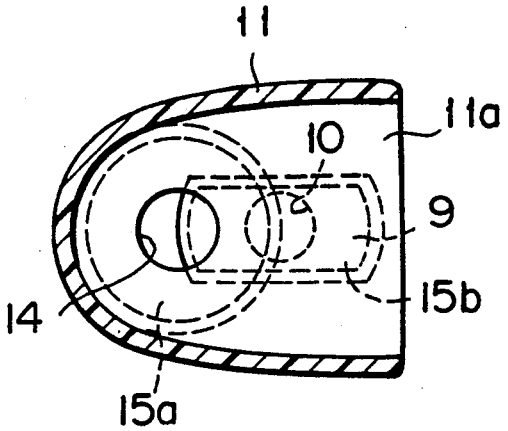
Figure 10:
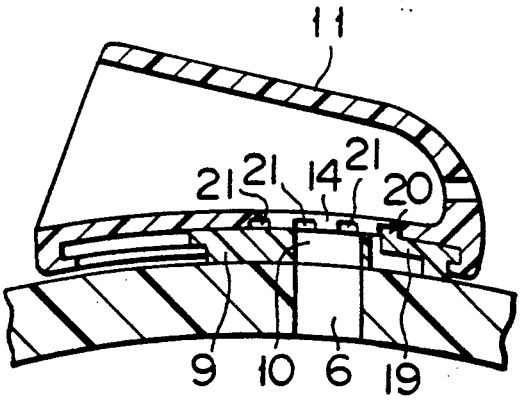
FIGS. 10 to 12 are sectional views illustrating another embodiment of the present invention wherein a ratchet mechanism is provided between a base plate and the induction duct.
Figure 11:
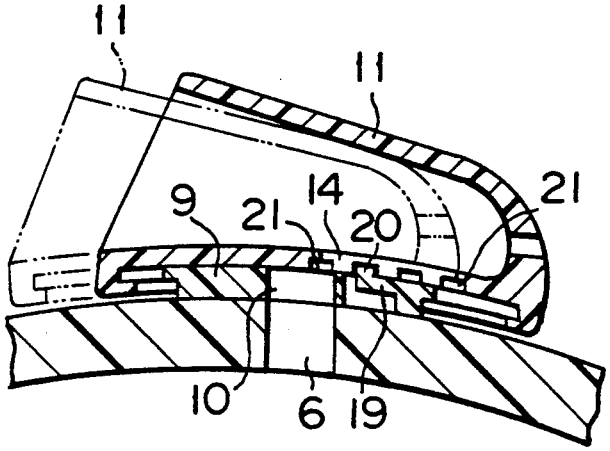
Figure 12:
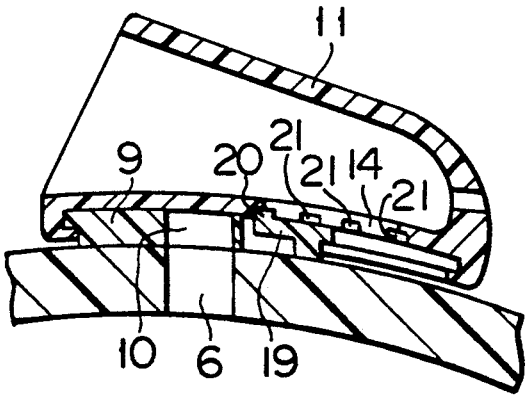
Figure 13:
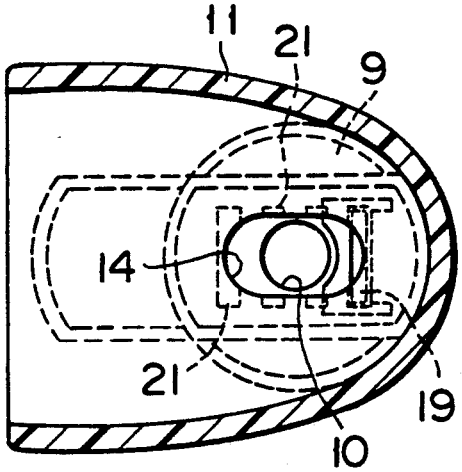
FIGS. 13 to 15 are plan views thereof in horizontal section.
Figure 14:
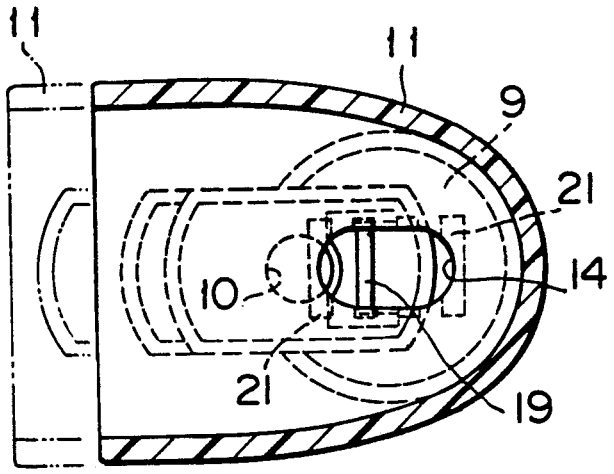
Figure 15:
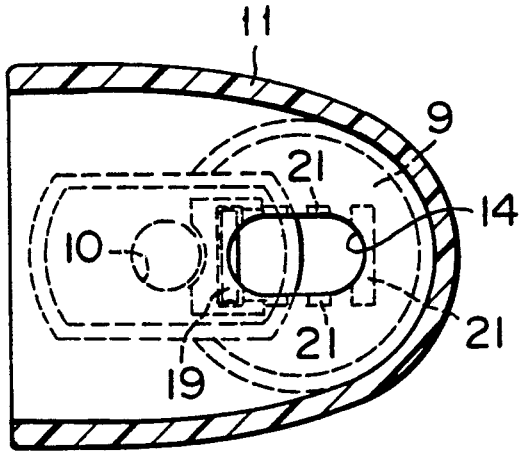

Further, in the state shown in FIG. 3, if the induction duct 11 is slid forwards (in the advancing direction), the communication hole 10 of the base plate 9 is closed with the bottom 11*a*, so that it is no longer possible to discharge the inside air from the helmet body A to the exterior. (See FIGS. 5 and 9.)

As is apparent from the above description, the ventilating device of the present invention can be changed in state to the discharging state of the inside air from the helmet by turning the induction duct 180° from the outside air introducing state shown in FIG. 2, to the stopped state of the discharge of the inside air from the helmet by sliding the duct forwards in the inside air discharging state, and further to the stopped state of the introduction of the outside air by sliding the duct backwards in the outside air introducing state.

In the drawings, the numeral 17 denotes a window opening formed in the front face of the helmet body A, and numeral 18 represents a transparent shield disposed in front of the window opening 17 to open and close the window opening.

What is claimed is:

1. A ventilating device for a helmet, comprising:

a ventilating passage extending through a cap member of a helmet body and further through a shock absorbing member from an outer surface of said cap member in a position near the head top and opening to the interior of said helmet body;

a base plate having a communication hole for communication with said ventilation passage and fixed to the outer surface of said cap member;

an induction duct attached to said base plate;

a rectilinear portion permitting a rectilinear sliding of said duct along said base plate, a circular portion permitting a horizontal rotation of the duct about the base plate in one side of said rectilinear portion, and the rectilinear portion and the circular portion being formed continuously and being connected with the induction duct; and a through-hole formed in a bottom portion of said induction duct in a central position of said circular portion in conformity and communication with said communication hole of said base plate, wherein said communication hole can be opened and closed by sliding said induction duct in a longitudinal direction in a mounted state of said base plate and the induction duct, and the supply of air into the interior of said helmet body and the discharge of air therefrom can be changed over from one to the other by rotating said induction duct.

2. A ventilating device for a helmet according to claim 1, wherein a small hole communicating with the interior of said induction duct is formed in a rear wall portion of the duct on the side opposite to a front opening portion of the duct.

3. A ventilating device for a helmet according to claim 1 or claim 2, wherein said induction duct is formed by a synthetic resin material having elasticity and is mounted so that it can be easily disengaged from said base plate when a large external force is exerted on the duct.

4. A ventilating device for a helmet according to claim 1, wherein between said base plate and said induction duct there is provided a ratchet mechanism for making a positional control at the time of rotation and longitudinal sliding of said induction duct.

* * * * *